United States Patent [19]

Carroll

[11] Patent Number: 5,005,606

[45] Date of Patent: Apr. 9, 1991

[54] ULTRA-SONIC REED CLEANING METHOD

[75] Inventor: Patrick R. Carroll, Greenwood, S.C.

[73] Assignee: Milliken Research Corporation, Spartanburg, S.C.

[21] Appl. No.: 62,411

[22] Filed: Jun. 15, 1987

Related U.S. Application Data

[63] Continuation of Ser. No. 791,792, Oct. 28, 1985, abandoned.

[51] Int. Cl.[5] ..... D03J 1/02; B08B 3/12; B01F 11/02

[52] U.S. Cl. ..... 139/1 C; 134/1

[58] Field of Search ..... 139/1 C; 134/1, 130, 134/136, 184

[56] References Cited

U.S. PATENT DOCUMENTS

| | | | |
|---|---|---|---|
| 2,842,143 | 7/1958 | Kearney | 134/1 X |
| 2,949,121 | 8/1960 | Kearney | 134/1 X |
| 3,033,710 | 5/1962 | Hightower et al. | 134/1 |
| 3,101,089 | 8/1963 | Brown et al. | 134/1 X |

FOREIGN PATENT DOCUMENTS

| | | | |
|---|---|---|---|
| 37-4569 | 6/1962 | Japan | 134/1 |
| 45-12961 | 5/1970 | Japan | 134/1 |
| 45-18762 | 6/1970 | Japan | 134/1 |
| 824538 | 12/1959 | United Kingdom | 134/1 |

*Primary Examiner*—Andrew M. Falik

*Attorney, Agent, or Firm*—Earle R. Marden; H. William Petry

[57] ABSTRACT

An ultra-sonic weaving machine reed cleaner in which the cleaner is moved adjacent the weaving machine and the reed is cleaned without disturbing the thread-up of the warp yarn in the reed. The method of using the system includes inserting the reed into a washing bin and then into a rinsing bin both of which are ultra-sonically treated to enhance the cleaning of the reed. Then the reed is blown free of line and liquid and returned to its operating position in the loom.

5 Claims, 3 Drawing Sheets

ULTRA-SONIC REED CLEANING METHOD

This application is a continuation of U.S. patent application Ser. No. 791,792, filed on Oct. 28, 1985 for ULTRA-SONIC REED CLEANING SYSTEM, now abandoned.

This invention relates generally to ultra-sonic cleaning of weaving machine reeds and in particular, to ultra-sonic cleaning of the reeds of a loom without removing the warp yarn from the reed.

Prior to this invention, loom reeds have been ultra-sonically cleaned to remove the sizing and finish deposited thereon by the warp yarn being woven by cutting the warp yarn, removing the reed from the loom and taking the reed to a remote position to be cleaned. This, of course, required a considerable amount of time, since the warp yarn on the loom then had to be re-strung through the reed.

Therefore, it is an object of the invention to provide an ultra-sonic reed cleaning system in which the reed is cleaned at the loom without disengaging the warp yarn from the reed.

Other objects and advantages of the invention will become readily apparent as the specification proceeds to describe the invention with reference to the accompanying drawings, in which.

Figure 1:
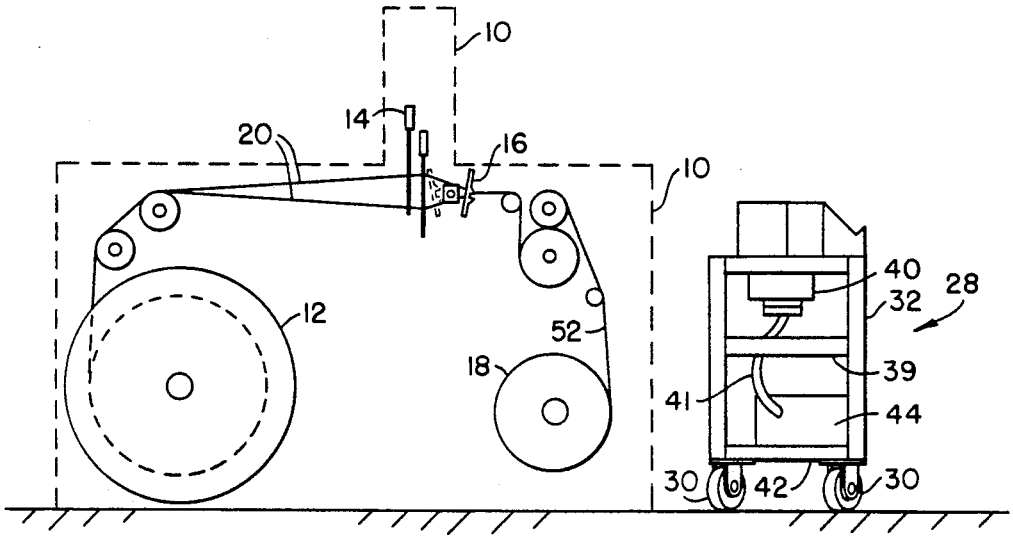
FIG. 1 is a schematic side elevation view of a loom with an ultra-sonic reed cleaner adjacent thereto.

Looking now to FIG. 1, the reference numeral 10 represents a conventional air jet loom having a warp beam 12, heddles 14, a reed 16 and a fabric take-up roll 18. Preferably, the invention concerns an air jet loom but obviously can be employed with any loom which requires cleaning of the reed.

As is well known in the art, the reed 16 is a comb-like device which spaces the warp yarn 20 in the desired order and also places each succeeding filling thread against that already woven. The reed usually consists of a top and bottom rib 22 of metal into which flat metal blades or wires 24 are set. The space between two adjacent wires is called a dent and the count or fineness of the reed is calculated by the number of dents per inch. The warp 20 is drawn through the dents and the sizing and/or finish in the yarn tends to accumulate in the dents. This accumulation is especially bad in the area below the weft tunnel 26 in the reed.

When it is desired to clean the size, finish and/or lint from the dents in the reed, the ultra-sonic reed cleaner 28 is moved on wheels 30 to a position adjacent the front or fabric side of the loom 10 as shown in FIG. 1. The size and number of ultra-sonic components on the ultra-sonic cleaner 28 depends primarily on the width of the reed to be cleaned.

Figure 3:
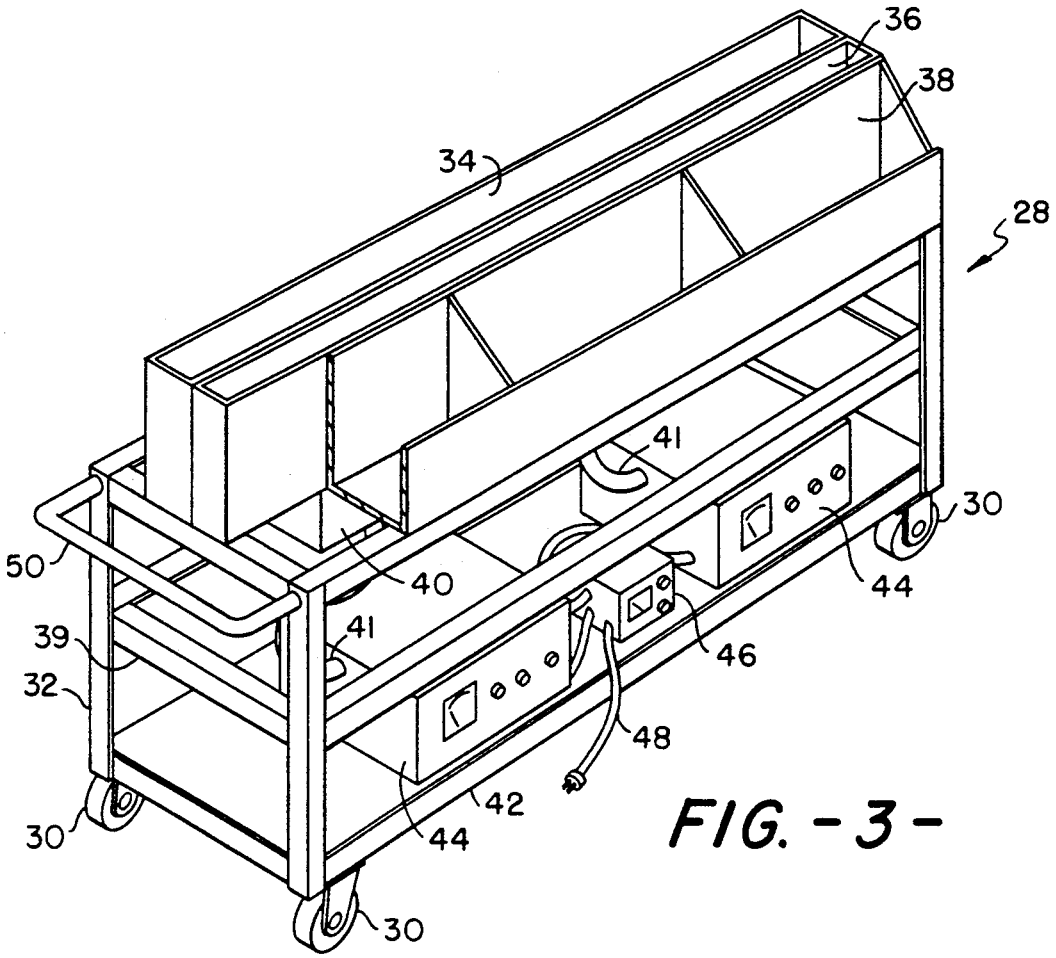
FIG. 3 is a perspective view of the ultra-sonic reed cleaner.
Figure 4:
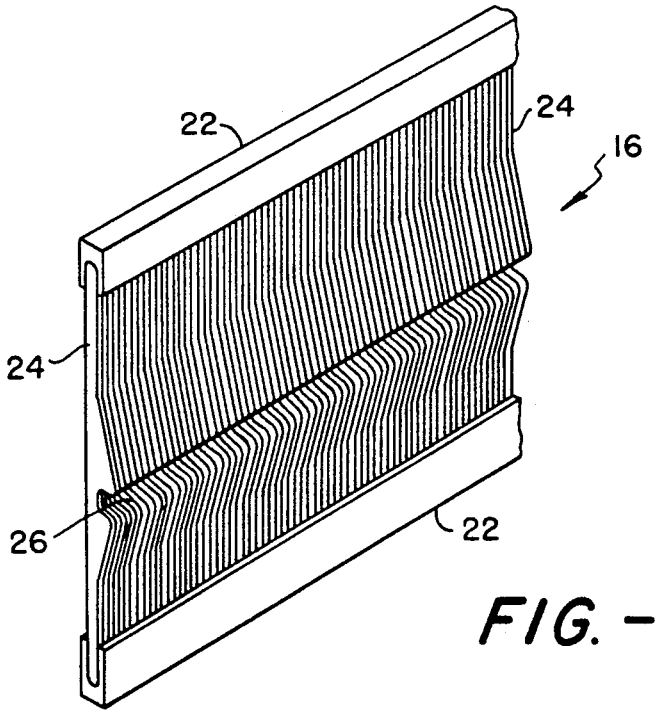
FIG. 4 is a perspective view of a typical reed for an air jet loom.

Looking at FIG. 3, the ultra-sonic cleaner 28 is shown in perspective with wheels 30 mounted thereon for easy movement of the cleaner. The cleaner basically consists of a rectangular metal frame 32 on top of which is located the cleaning bins 34, 36 and 38. Bin 34 is the primary bin for insertion of the reed 16 for washing in a surfactant cleaning solution. Bin 36 is basically for rinsing the washed reed and bin 38 is for a final blowing of the reed to remove any retained particles and liquid. Mounted directly below the bins 34, 36 and 38, above a shelf 39, are a plurality of transducers 40 which supply ultra-sonic vibration or energy to the bins 34 and 36. Mounted below each of the transducers on shelf 42 and connected thereto by cable 41, is its generator 44. Located on the shelf 42 is a switching device 46 supplied 110 A.C. via conduit 48 to alternately switch the current from one generator to the other to cut down on the amount of wiring necessary to operate the cleaner 28. A handle 50 is mounted to the upper portion of the frame 32 to and in the movement of the cleaner 28.

Figure 2:
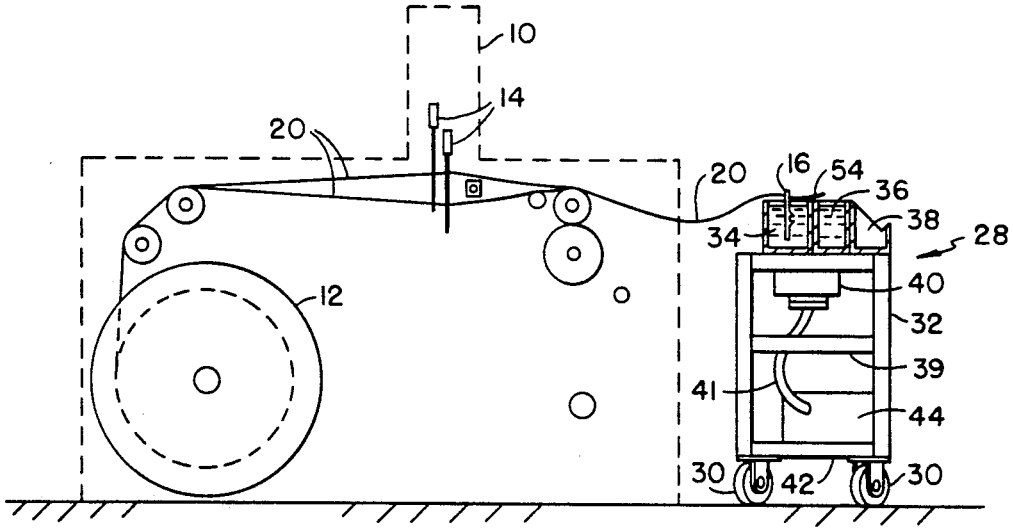
FIG. 2 is a view similar to FIG. 1 showing the loom reed disposed in the reed cleaner.
Figure 5:
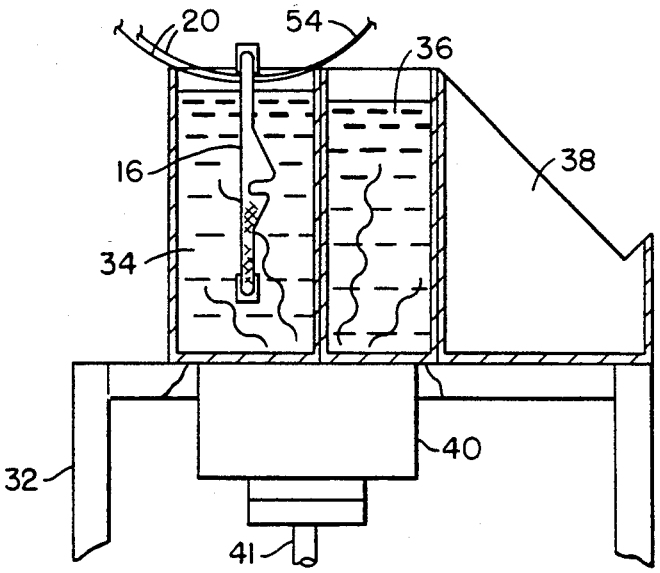
FIG. 5 is an enlarged cross-section view of the reed cleaner with the reed located in the cleaning compartment.

When it is desired or time to clean the reed 16, the loom 10 is stopped and the ultra-sonic cleaner 28 is moved adjacent the front end of the loom as shown in FIG. 1. Then, the woven fabric 52 is severed about 3 inches from the last weft insertion leaving a strip 54 of woven fabric attached to the weft yarn. Then, the reed 16 is removed from its support and the warp beam is let off to allow warp yarn to be unwound therefrom as the reed 16 is pulled towards the cleaner 28 to drop the reed into the cleaning bin 34. The conduit 48 is then plugged into a suitable electrical source and the switching mechanism 46 activated to alternately supply voltage to the selected generator 44. The reed 16 is now in the position shown in FIGS. 2 and 5 with the transducer 40 energized to supply ultra-sonic vibration to the bath in the bin 34. The ultra-sonic energy being supplied to the bath in the bin 34 excites the molecules in the bath to enhance the cleaning of the size, finish, etc. from the dents of the reed 16.

Figure 6:
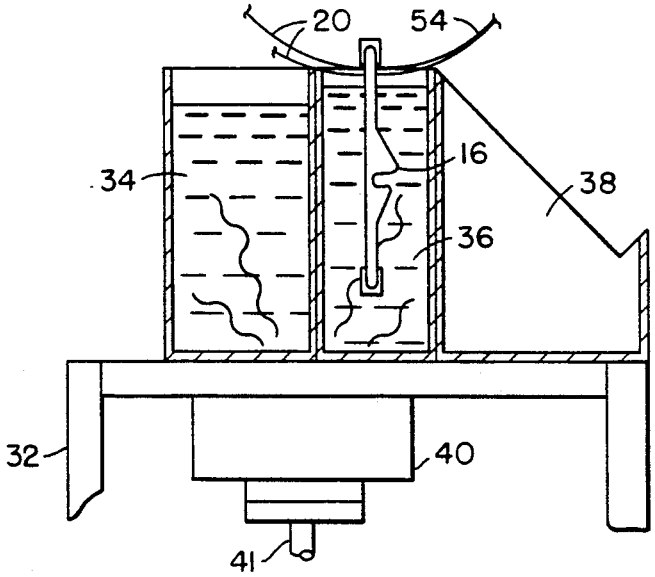
FIG. 6 is a view similar to FIG. 5 showing the reed in the rinsing compartment; and, FIG. 7 is similar to FIGS. 5 and 6 showing the reed being blown clean after washing.
Figure 7:
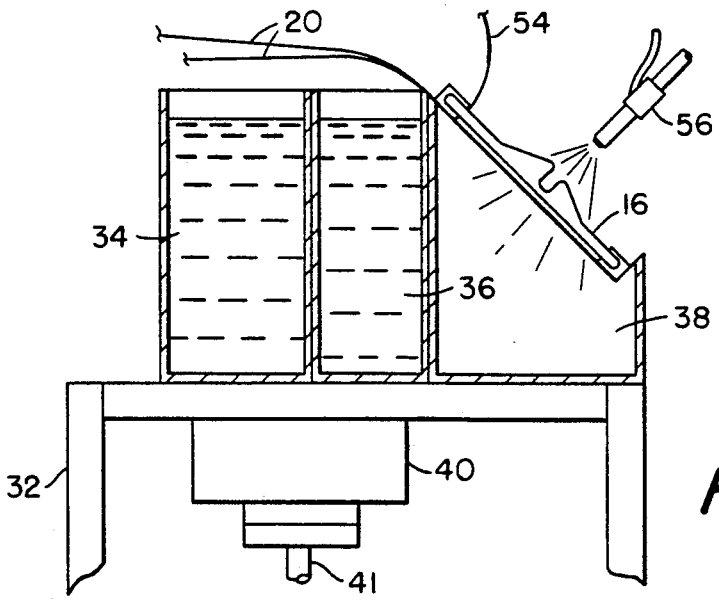

When the reed 16 has been in the bin 34 for a time sufficient to clean same, it is removed and placed in the rinse bin 36 as shown in FIG. 6. From the rinse bin 36, the reed 16 ia placed on top of the bin 38 and blown clean of liquid and contaminants by high pressure air from an air nozzle 56 from a high pressure air source, not shown.

Once the reed 16 has been cleaned, it can be removed from the cleaner 28, placed back into its support in the loom, the cleaner 28 removed, the strip 54 connected to a take-up beam 18 and the loom restarted with warp yarn already threaded through the dents of the reed 16.

It can readily be seen that an ultra-sonic cleaning apparatus has been described which is simple and readily useable at the loom. The loom reeds are cleaned without excessive down time and the re-threading of the reed has been eliminated.

Although the preferred embodiment of the invention has been described in detail, it is contemplated that many changes may be made without departing from the scope or spirit of the invention and I desire to be limited only by the claims.

I claim:

1. The method of servicing a loom reed comprising the steps of: subjecting the loom reed at the loom, with the warp yarns remaining in the reed, to the action of a cleaning liquid to which an ultrasonic force is applied for a time sufficient to apply a cleaning action to the reed; then subjecting the loom reed, with the warp yarns remaining in the reed, to the action of a rinsing liquid to which an ultrasonic force is applied for a time sufficient to apply a rinsing action to the reed, and then applying an air cleaning and drying action to the loom reed without damaging the warp yarns in the reed.

2. A method of cleaning the dents of a loom reed while the warp yarns remain threaded therethrough comprising the steps of: moving a julticompartment ultra-sonic cleaning device adjacent the front of a loom, severing the fabric produced on the loom adjacent the cleaning device leaving a predetermined amount of fabric connected to the warp yarns threaded through the dents of the loom reed, removing the reed from the loom and placing it into one of the compartments of the cleaning device with the yarns still threaded through the dents, actuating the ultra-sonic cleaning device to clean the dents of the loom, removing the reed from the cleaning compartment and placing into another compartment with liquid therein to rinse same, removing the reed from the ultra-sonic cleaning device and replacing it in the loom, moving the cleaning device away from the loom and restarting the loom to produce woven fabrics.

3. The method of claim 2 wherein the reed is blown free of liquid and debris after removal from the rinsing compartment.

4. The method of claim 2 wherein the reed is blown free of liquid and debris after it has been placed over another compartment in the ultra-sonic cleaning device.

5. A method of cleaning the dents of a loom reed while the warp yarns remain threaded through the dents of the reed comprising the steps of: moving an ultra-sonic cleaner adjacent the front of the loom, removing the reed from the loom with the warp yarns threaded therethrough and placing it in the cleaner, ultra-sonically cleaning the reed, placing the cleaned reed back into the loom, removing the ultra-sonic cleaner from adjacent the loom and restarting the loom, said cleaning step including the steps of rinsing and blowing air through the dents of the reed.

* * * * *